US005815049A

United States Patent [19]

Cappelli

[11] Patent Number: 5,815,049

[45] Date of Patent: Sep. 29, 1998

[54] MAGNETIC COUPLING OF A WAVEGUIDE SWITCH TO A COAXIAL SWITCH

[76] Inventor: Guido G. Cappelli, 46 Browning Dr., Dollard-des-Ormeaux, Quebec, Canada, H9G 2K4

[21] Appl. No.: 814,474

[22] Filed: Mar. 10, 1997

Related U.S. Application Data

[63] Continuation-in-part of Ser. No. 598,707, Feb. 8, 1996, abandoned.

[51] Int. Cl.[6] ..... H01P 1/10

[52] U.S. Cl. ..... 333/106; 333/107; 335/4; 335/5

[58] Field of Search ..... 333/101, 106, 333/107, 108; 335/4, 5

[56] References Cited

U.S. PATENT DOCUMENTS

| | | | |
|---|---|---|---|
| 2,999,213 | 9/1961 | Olivieri et al. | 333/106 |
| 4,652,841 | 3/1987 | Hudspeth et al. | 333/107 |
| 5,155,456 | 10/1992 | Ruff et al. | 333/106 |
| 5,471,183 | 11/1995 | Hettlage et al. | 335/4 |

*Primary Examiner*—Paul Gensler
*Attorney, Agent, or Firm*—ROBIC

[57] ABSTRACT

A dual switch for coupling a waveguide microwave switch to a coaxial microwave switch. The waveguide microwave switch has a waveguide hollow member and a waveguide rotating section rotatably mounted about a rotational axis within the waveguide hollow member at one end. The coaxial microwave switch has a coaxial hollow member adjacent to the one end of the waveguide hollow member and a coaxial rotating section rotatably mounted within the coaxial hollow member about an axis coaxial with the rotational axis. The waveguide microwave switch is coupled to the coaxial microwave switch by at least one set of cooperating magnets fastened at a given radial distance from the rotational axis to the waveguide rotating section and the coaxial rotating section respectively, such that any rotation of the waveguide rotating section about the rotational axis will be followed by a corresponding rotation about the rotational axis of the coaxial rotating section. The set of magnets includes two magnets located radially opposite each other on the waveguide rotating section near its end and two pairs of magnets located radially opposite each other on the coaxial rotating section so that the magnets are centered between the pairs of magnets and repulse each other. This eliminates any openings between the waveguide microwave switch and the coaxial microwave switch and thus any radio-frequency leakage between the two switches.

10 Claims, 4 Drawing Sheets

MAGNETIC COUPLING OF A WAVEGUIDE SWITCH TO A COAXIAL SWITCH

RELATED APPLICATION

This application is a continuation-in-part of U.S. patent application Ser. No. 08/598,707, filed Feb. 8, 1996, now abandoned.

FIELD OF THE INVENTION

The invention relates to a dual switch for coupling a waveguide microwave switch to a coaxial microwave switch.

DESCRIPTION OF THE PRIOR ART

Dual switches, also called ganged switches, are known per se to mechanically latch a coaxial microwave switch to a waveguide microwave switch in order to align the ports of the waveguide switch and the ports of the coaxial switch at the same time.

A motor usually drives both the rotating waveguide section of the switch and the rotating coaxial section of the switch, as these two sections are mechanically connected through the use of metal rods or similar means. The major disadvantage of this arrangement is the unwanted radio frequency (R.F.) leakage between the waveguide and coaxial sections, commonly called "signal crosstalk", due to the openings necessary to mechanically connect the two sections. This problem can be attenuated by using absorbing materials, but a high degree of isolation between the two sections cannot be achieved.

The dual switch 100 according to the prior art, shown in FIG. 1, includes a waveguide microwave switch 200, a coaxial microwave switch 300 and means to attach the waveguide microwave switch 200 to the coaxial microwave switch 300.

The waveguide microwave switch 200 has a waveguide hollow member 50 and a waveguide rotating section 70 rotatably mounted about a rotational axis 180 within the waveguide member 50 at one end 190 thereof.

The coaxial microwave switch 300 has a coaxial hollow member 90 adjacent to the end 190 of the waveguide hollow member 50 and a coaxial rotating section 110 rotatably mounted within the coaxial hollow member 90 about an axis coaxial with the rotational axis 180 and coaxial R.F. output ports 170 which have contacts 310 projecting towards the coaxial rotating section 110. The coaxial rotating section 110 is provided with coaxial lines 330 which serve to connect one R.F. output port 170 with another R.F. output port 170.

The waveguide rotating section 70 and the coaxial rotating section 110 have opposite surfaces facing each other perpendicular to the rotational axis 180, extending between the opposite surfaces. In the prior art, the means to couple the waveguide rotating section 70 to the coaxial rotating section 110 includes rods 130 fastened to the waveguide rotating section 70 and to the coaxial rotating section 110 through slots 150 machined in a separating plate 120. With this arrangement, the R.F. present in the waveguide rotating section 70 will leak through the slots 150 into the coaxial rotating section 110 with unwanted interference.

SUMMARY OF THE INVENTION

It is an object of the invention to provide an improved dual switch that does not connect the waveguide section to the coaxial section through mechanical means and which will present virtually infinite isolation between the two sections.

In accordance with the invention, this object is achieved through the magnetic action of magnets attached to both the waveguide rotating section and the coaxial rotating section.

More particularly, this object is achieved in a dual switch including:

a waveguide microwave switch having a waveguide hollow member and a waveguide rotating section rotatably mounted about a rotational axis within the waveguide hollow member at one end;

a coaxial microwave switch having a coaxial hollow member adjacent to the one end of the waveguide hollow member and a coaxial rotating section rotatably mounted within the coaxial hollow member about an axis coaxial with the rotational axis; and coupling means for coupling the waveguide microwave switch to the coaxial microwave switch, where the coupling means includes at least one set of cooperating magnets fastened at a given radial distance from the rotational axis to the waveguide rotating section and the coaxial rotating section respectively, such that any rotation of the waveguide rotating section about the rotational axis will be followed by a corresponding rotation about the rotational axis of the coaxial rotating section.

BRIEF DESCRIPTION OF THE DRAWINGS

The present invention and its advantages will be more easily understood after reading the following non-restrictive description of a preferred embodiment thereof, made with reference to the following drawings, where.

DESCRIPTION OF A PREFERRED EMBODIMENT OF THE INVENTION

Figure 1:
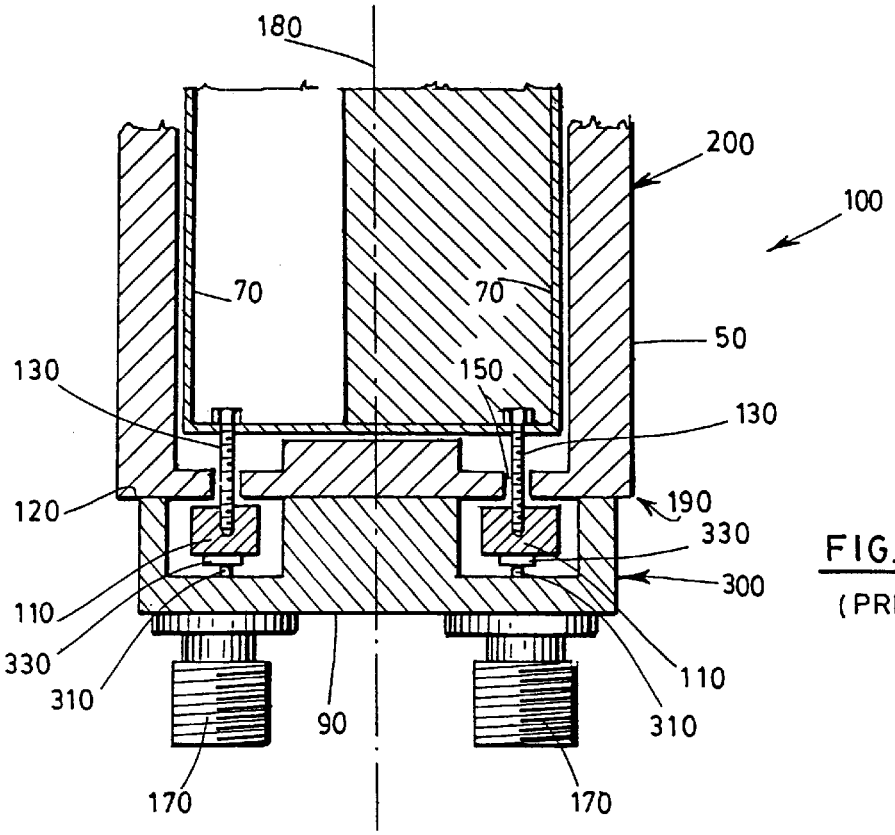
FIG. 1 (PRIOR ART)
FIG. 1 is a longitudinal cross-sectional view of a dual switch according to the prior art.

It is therefore desirable to provide means to couple the waveguide rotating section 70 to the coaxial rotating section 110 which will insure against leakage from the waveguide rotating section 70 to the coaxial rotating section 110. According to the preferred embodiment of the invention shown in FIGS. 2 and 3, this is achieved by using two sets of cooperating magnets 21, 25 and 23, 27, fastened at a given radial distance from the rotational axis 18 to the waveguide rotating section 7 and the coaxial rotating section 11, so that any rotation of the waveguide rotating section 7 will be closely followed by a corresponding rotation of the coaxial rotating section 11.

As such, the dual switch 1 according to the invention includes a waveguide microwave switch 2, a coaxial microwave switch 3 and means to couple the waveguide microwave switch 2 to the coaxial microwave switch 3.

Figure 7:
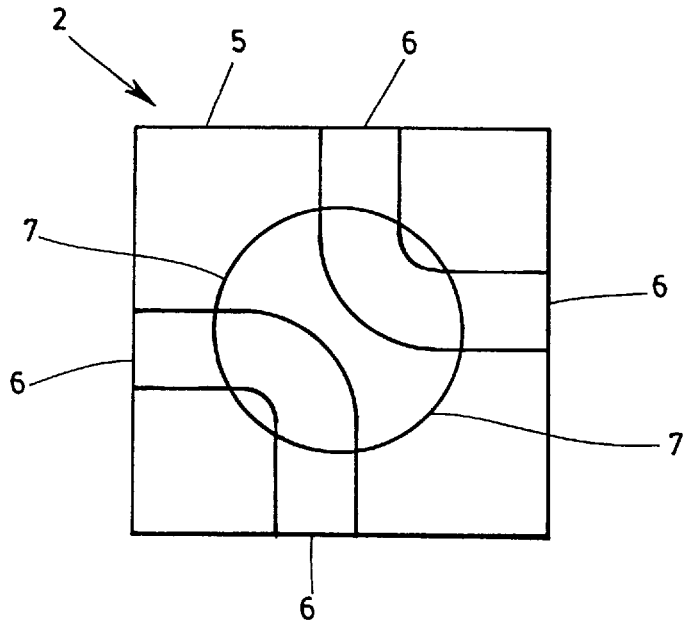
FIG. 7 is a schematic representation of a typical waveguide switch for use with the invention.

The waveguide microwave switch 2 has a waveguide hollow member 5 and a waveguide rotating section 7 rotatably mounted about a rotational axis 18 within the waveguide member 5 at one end 19 thereof in order to align two pairs of ports 6, as shown in FIG. 7.

Figure 5:
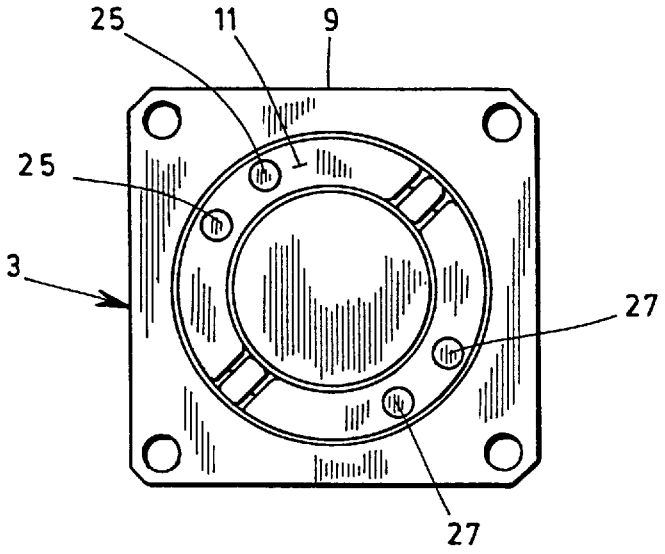
FIG. 5 is a top plan view of coaxial switch for use with the invention.
Figure 6:
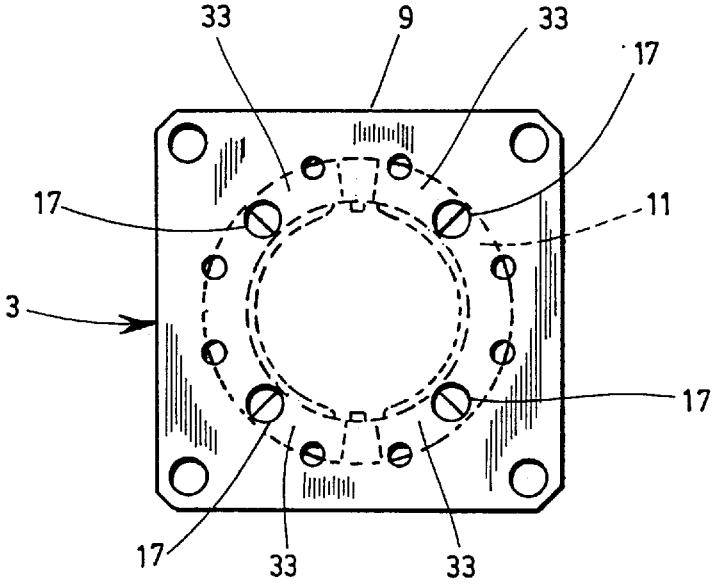
FIG. 6 is a bottom view of the coaxial switch of FIG. 5.

The coaxial microwave switch 3 has a coaxial hollow member 9 adjacent to the end 19 of the waveguide hollow member 5 and a coaxial rotating section 11, preferably made of a dielectric material, rotatably mounted within the coaxial hollow member 9 about an axis coaxial with the rotational axis 18 and coaxial R.F. output ports 17 which have contacts 31 projecting towards the coaxial rotating section 11. The coaxial rotating section 11 is provided with coaxial lines 33 which serve to connect one R.F. output port 17 with another R.F. output port 17, as better shown in FIGS. 5 and 6. It should be noted that the coaxial rotating section 11 is rotated by 45° counterclockwise in FIG. 6 with respect to FIG. 5. For example, in FIG. 6, the two topmost ports 17 are connected and the two bottom ports 17 are connected.

The waveguide rotating section 7 and the coaxial rotating section 11 have opposite surfaces facing each other perpendicular to the rotational axis 18. Preferably, a plate 20 extends between the opposite surfaces.

Figure 4:
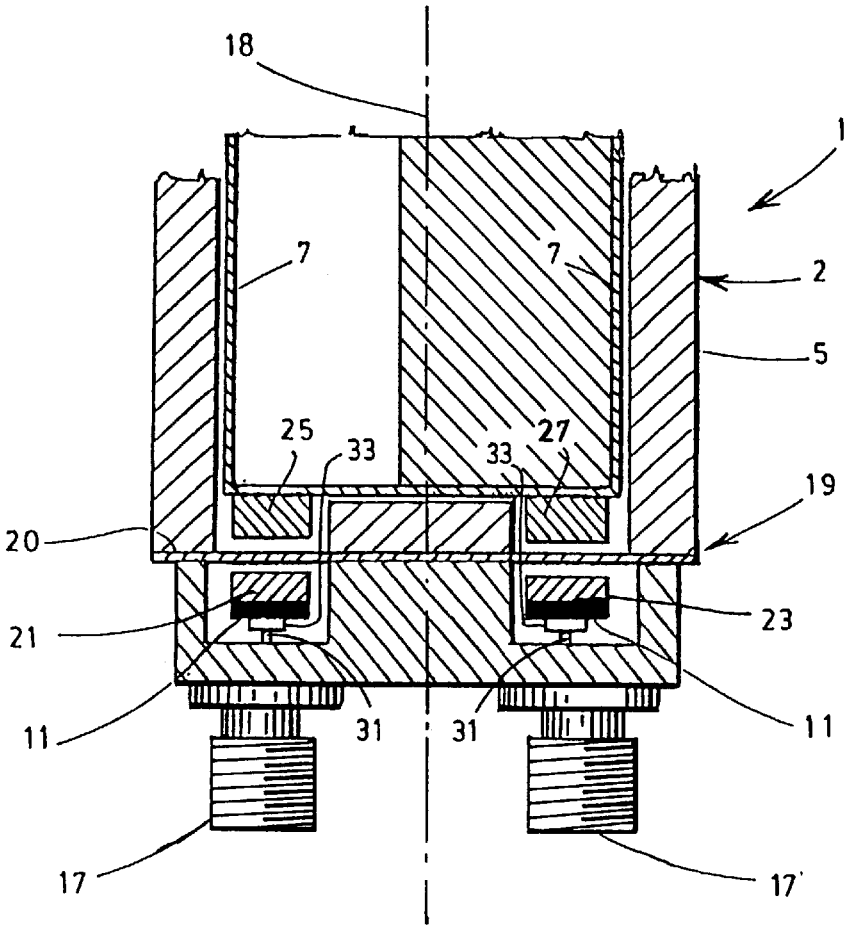
FIG. 4 is a longitudinal cross-sectional view of a dual switch according to an alternative embodiment of the invention.

The two sets of magnets are symmetrical triplets of magnets. Two magnets 21, 23 are fastened radially opposite each other on the waveguide rotating section 7 at a given radial distance near the end 19 and two pairs of repulsive magnets 25, 27 are fastened radially opposite each other on the coaxial rotating section 11 such that the pairs of magnets 25, 27 face the magnets 21, 23. Alternatively, the two magnets 21, 23 could be fastened radially opposite each other on the coaxial rotating section and the two pairs of repulsive magnets 25, 27 could be fastened radially opposite each other on the waveguide rotating section, as shown on FIG. 4.

Preferably, the magnets 21, 23 and the pairs of magnets 25, 27 are thin, high magnetic density magnets. The pairs of magnets 25, 27 are preferably spaced in such a way that each magnet 21, 23 is centered with respect to each pair of magnets 25, 27, as better shown in FIG. 3. This arrangement provides for a minimum number of repelling magnetic lines between the magnets 21, 23 and the pairs of magnets 25, 27 when the magnets 21, 23 are centered with respect to the pairs of magnets 25, 27. Thus, any rotation of the waveguide rotating section 7 will tend to increase the number of repelling magnetic lines between the magnets 21, 23 and the pairs of magnets 25, 27 and only a corresponding rotation of the coaxial rotating section 11 will decrease the number of repelling magnetic lines. Therefore, the coaxial rotating section 11 will closely follow any rotation of the waveguide rotating section 7.

Figure 2:
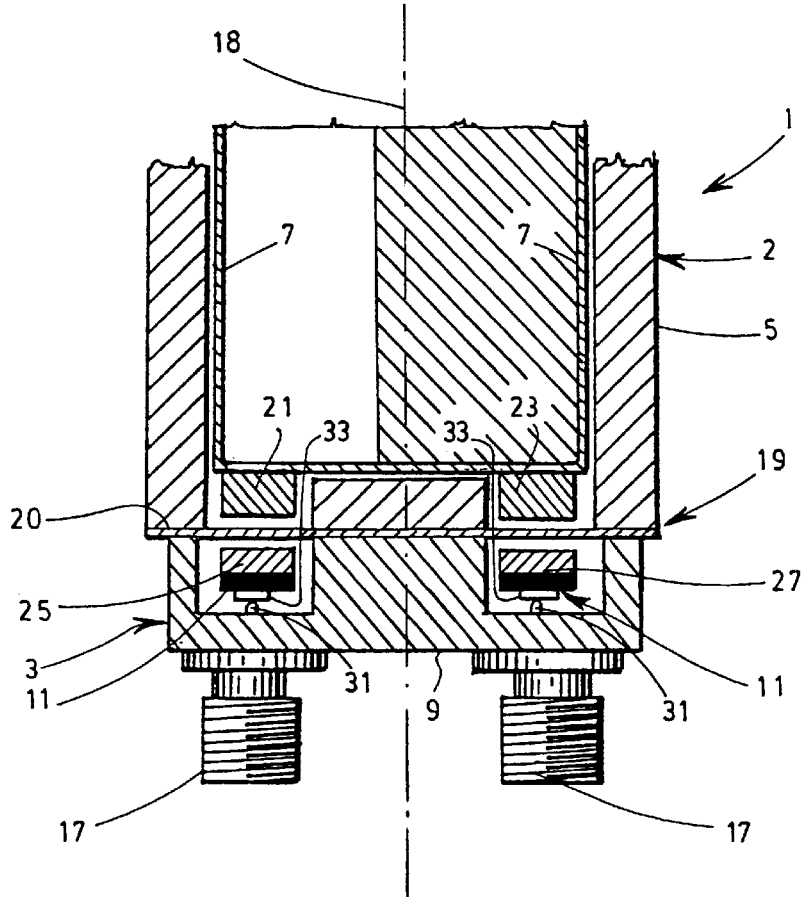
FIG. 2 is a longitudinal cross-sectional view of a dual switch according to the preferred embodiment of the invention.
Figure 3:
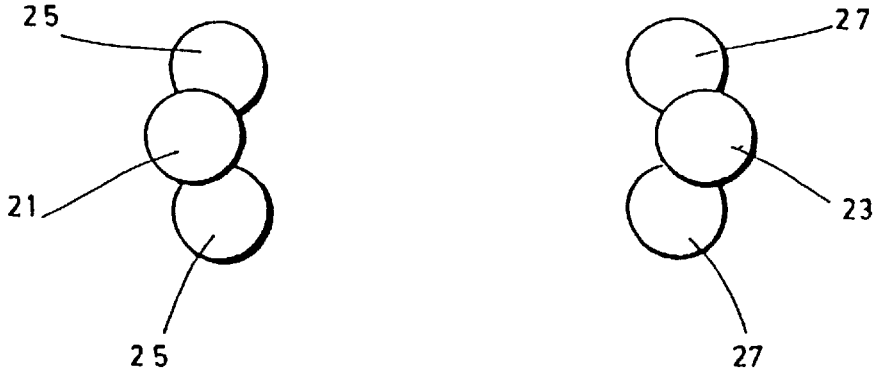
FIG. 3 is a top view of the location of the magnets according to the preferred embodiment of the invention.

The arrangement shown on FIG. 2 has proven to provide good repeatability of the position of the coaxial rotating section 11 with respect to the waveguide rotating section 7 and has achieved the goal of eliminating any openings between the two sections which would leak unwanted R.F.

Although the present invention has been explained hereinabove by way of a preferred embodiment thereof, it should be pointed out that any modifications to this preferred embodiment within the scope of the appended claims is not deemed to alter or change the nature and scope of the present invention. For example, the set of cooperating magnets could comprise two symmetrical pairs of attracting magnets fastened to the opposite surfaces of the waveguide rotating section and the coaxial rotating section respectively, at a same radial distance.

What is claimed is:

1. In a dual switch comprising:

a waveguide microwave switch having a waveguide hollow member and a waveguide rotating section rotatably mounted about a rotational axis within said waveguide hollow member at one end thereof;

a coaxial microwave switch comprising a coaxial hollow member adjacent to the one end of the waveguide hollow member, and a coaxial rotating section rotatably mounted within said coaxial hollow member about an axis coaxial with said rotational axis;

said waveguide rotating section and said coaxial rotating section having opposite surfaces facing each other;

coupling means for coupling said waveguide microwave switch to said coaxial microwave switch each switch carrying different signals;

the improvement wherein said coupling means comprises at least one set of cooperating magnets fastened at a given radial distance from said rotational axis of said waveguide rotating section and said coaxial rotating section respectively;

wherein rotation of said waveguide rotating section about said rotational axis will be followed by a corresponding rotation about said rotational axis of said coaxial rotating section.

2. The improved dual switch according to claim 1, wherein a separating plate perpendicular to said rotational axis extends between said opposite surfaces.

3. The improved dual switch according to claim 1, wherein said at least one set of magnets comprises at least two symmetrical triplets of repulsive magnets fastened to the opposite surfaces of said waveguide rotating section and said coaxial rotating section respectively, at a same radial distance from said rotational axis, such that one magnet of said triplet is located on one of said opposite surfaces and two magnets of said triplet are located on the other of said opposite surfaces and surround the one magnet so that the one magnet remains centered between the two magnets.

4. The improved dual switch according to claim 3, wherein a separating plate perpendicular to said rotational axis extends between said opposite surfaces.

5. The improved dual switch according to claim 1, wherein said at least one set of magnets comprises:

a magnet fastened on said waveguide end at a given radial distance;

a pair of magnets fastened on said coaxial rotating section at said given radial distance and positioned so that said magnet is centered between said pair of magnets;

where said magnet and said pair of magnets repel each other, such that said magnet will tend to remain centered between said pair of magnets.

6. A dual switch according to claim 5, wherein said set of magnets comprises two such sets located radially opposite each other.

7. The improved dual switch according to claim 6, wherein a separating plate perpendicular to said rotational axis extends between said opposite surfaces.

8. A dual switch according to claim 1, wherein said at least one set of magnets comprises:

a magnet fastened on said coaxial rotating section at a given radial distance;

a pair of magnets fastened on said waveguide end at said given radial distance and positioned so that said magnet is centered between said pair of magnets;

where said magnet and said pair of magnets repel each other such that said magnet will tend to remain centered between said pair of magnets.

9. A dual switch according to claim 8, wherein said set of magnets comprises two such sets located radially opposite each other.

10. The improved dual switch according to claim 9, wherein a separating plate perpendicular to said rotational axis extends between said opposite surfaces.

* * * * *